US005837670A

United States Patent [19]

Hartshorn

[11] Patent Number: 5,837,670

[45] Date of Patent: Nov. 17, 1998

[54] DETERGENT COMPOSITIONS HAVING SUDS SUPPRESSING PROPERTIES

[76] Inventor: Richard Timothy Hartshorn, 8 Hersham Close, Kingston Park, Newcastle upon Tyne, NE3 2TN, Great Britain

[21] Appl. No.: 737,943

[22] PCT Filed: Apr. 18, 1995

[86] PCT No.: PCT/US95/04758

§ 371 Date: Nov. 21, 1996

§ 102(e) Date: Nov. 21, 1996

[87] PCT Pub. No.: WO95/32268

PCT Pub. Date: Nov. 30, 1995

[51] Int. Cl.[6] ..... C11D 3/32; C11D 3/395; C11D 1/10

[52] U.S. Cl. ..... 510/490; 510/501; 510/313; 510/372

[58] Field of Search ..... 510/488, 490, 510/501, 310, 312, 313, 345, 372, 378

[56] References Cited

U.S. PATENT DOCUMENTS

| | | | |
|---|---|---|---|
| 4,283,301 | 8/1981 | Diehl | 252/102 |
| 4,507,280 | 3/1985 | Pohl et al. | 424/70 |
| 4,634,551 | 1/1987 | Burns et al. | 252/102 |
| 4,704,226 | 11/1987 | Naylor | 252/162 |
| 4,852,989 | 8/1989 | Burns et al. | 8/107 |
| 4,983,383 | 1/1991 | Maksimosi et al. | 424/70 |
| 5,174,927 | 12/1992 | Honsa | 252/543 |
| 5,328,630 | 7/1994 | Nozaki et al. | 252/117 |
| 5,338,491 | 8/1994 | Connor et al. | 252/548 |
| 5,344,643 | 9/1994 | Thiel et al. | 424/70 |
| 5,414,099 | 5/1995 | Heinzmann et al. | 554/69 |

FOREIGN PATENT DOCUMENTS

| | | |
|---|---|---|
| 505129 B1 | 6/1995 | European Pat. Off. . |
| 50-150701 | 12/1975 | Japan . |
| 64-16900 | 1/1989 | Japan . |
| 64-1798 | 1/1989 | Japan . |

*Primary Examiner*—Paul Lieberman
*Assistant Examiner*—John R. Hardee
*Attorney, Agent, or Firm*—Ian S. Robinson; Brian M. Bolam; Kim William Zerby

[57] ABSTRACT

A detergent composition formulated with conventional detersive surfactants, optional builders, detergent adjuncts and a suds suppressor, wherein said suds suppressor is an amino acid of formula (I), or its alkali metal, alkaline earth metal salt or mixtures thereof, wherein $R_1$ is an alkyl, aryl or alkaryl group containing from 1 to 14 carbon atoms, $R_2$ is an alkylene, arylene or alkarylene group containing from 1 to 14 carbon atoms, $R_5$ is H or an alkyl aryl, or alkaryl group containing from 1 to 10 carbon atoms. The invention also relates to a detergent composition comprising a mixture of amidoacid and amidoperacid suds suppressors and to an aqueous wash liquor containing a detersive surfactant comprising a $C_{10}$–$C_{20}$ alkyl sulphate, optionally together with builders and detergent adjuncts and a suds suppressor compound wherein said suds suppressor is formed from a suds suppressor precursor.

$$R_1-\underset{\underset{O}{\|}}{C}-\underset{\underset{R_5}{|}}{N}-R_2-COOH \qquad (I)$$

or $$R_1-\underset{\underset{R_5}{|}}{N}-\underset{\underset{O}{\|}}{C}-R_2-COOH$$

7 Claims, No Drawings

DETERGENT COMPOSITIONS HAVING SUDS SUPPRESSING PROPERTIES

FIELD OF THE INVENTION

The present invention relates to detergent compositions having suds suppressing properties. More particularly, the present invention relates to new suds suppressor compounds.

BACKGROUND OF THE INVENTION

Detergent compositions containing high levels of surfactants are known in the art. Surfactants such as anionic, nonionic or cationic are required to aid grease removal and maintain soil suspension from fabrics. More particularly, high levels of anionic surfactants are desirable to provide whiteness maintenance. However, a problem encountered with the use of some high levels of surfactants, especially high foaming anionic surfactants, is the propensity of the surfactant to give high levels of sudsing; this problem being particularly more acute at high temperature.

Traditionally, the suppression of suds has been enabled by the use of high level of suds suppressor such as silicones, fatty acids and twin chain alcohols. However a problem encountered by such use is their expensive cost for few detergency benefits.

Peracid precursors are also known for providing more effective bleaching. Particularly effective are the hydrophobic bleach precursor such as Nonanoyl Oxy Benzene Sulphonate (NOBS), which generates a fatty acid by-product in the wash liquor. However, this is ineffective at controlling suds in high temperatures wash conditions.

Further hydrophobic bleach precursors known in the art are described in U.S. Ser. No. 08/064,563 and EP 0170386.

U.S. Ser. No. 08/064,563 teaches an amidoperoxy compound and its precursors such as (6-octanamidocaproyl) oxybenzenesulphonate, (6-nonamidocaproyl) oxybenzene sulphonate, (6-decanamidocaproyl) oxybenzene sulphonate and mixtures thereof compatible with enzyme which has a bleach cleaning and enzyme cleaning performance. It discloses a detergent composition with nil-LAS surfactant, and teaches that the amidoperoxy compound can be formulated with hydrophilic activators such as TAED. EP 0170386 teaches amidoperoxy compound and their precursors in a peroxygen bleaching composition which provide effective bleaching of textiles over a wide range of temperatures.

It has now been found that amidoperoxy compounds and their precursors such as described in U.S. Ser. No. 08/064,563 and EP 0170386 gives further enhanced suds suppressing properties.

Furthermore, it has also been found that amidoacid compounds have suds suppressing properties.

It is an object of the invention to provide a detergent composition comprising new suds suppressor compounds selected from amidoacid and mixtures of amidoacid and amidoperacid. It is further object of the invention to provide an aqueous wash liquor containing a detersive surfactant comprising a $C_{10}$–$C_{20}$ alkyl sulphate, optionally together with builders, detergent adjuncts and a suds suppressor wherein said suds suppressor is formed from a suds suppressor precursor.

SUMMARY OF THE INVENTION

The present invention encompasses a detergent composition formulated with conventional detersive surfactants, optional builders, detergent adjuncts and a suds suppressor, wherein said suds suppressor is an amidoacid of formula

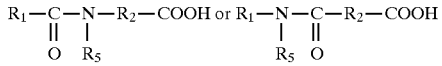

or its alkali metal, alkaline earth metal salts or mixture thereof, wherein $R_1$ is an alkyl, aryl or alkaryl group containing from 1 to 14 carbon atoms, $R_2$ is an alkylene, arylene or alkarylene group containing from 1 to 14 carbon atoms, $R_5$ is H or an alkyl, aryl, or alkaryl group containing from 1 to 10 carbon atoms.

DETAILED DESCRIPTION OF THE INVENTION

The present invention contemplates detergent compositions having suds suppressing properties.

An essential component useful for the purpose of the invention is a suds suppressor compound in a detergent composition formulated with conventional detersive surfactants, optional builders, detergent adjuncts, wherein said suds suppressor is selected from amidoacid and mixtures of amidoacid and amidoperacid.

Levels of said surfactants in the detergent composition will typically be from 1% to 80% by weight of the detergent composition and levels of said suds suppressor from 0.025% to 20% by weight of the detergent composition.

The described compounds, i.e. amidoacid and mixture of amidoacid and amidoperacid, exhibit excellent suds suppressing properties and may be used as a 'detergent active' suds suppressor or as a co-suds suppressor agent.

By 'detergent active', it is meant that further to its suds suppressing activity, the amidoacid or the mixture of amidoacid and amidoperacid gives also a bleaching activity with or without a bleaching agent. When used as a co-suds suppressor agent, the development encompasses two advantages:

Firstly, it enhances the suds suppressing properties of the detergent composition.

Secondly, it allows the use of lower than conventional levels of expensive suds suppressors such as silicone, fatty acid, twin-chain alcohols; thus reducing the cost of the product.

Additionally, the suds suppressing properties of this development are retained in the presence of organic peroxyacid bleaches derived from mixtures of perhydrates and precursors which contain one or more N-acyl or O-acyl group such as TAED, NOBS, acyl lactam and cationic precursors, or preformed peracids such as amido peracids or diperacids.

The presence of such peroxyacid bleaches permits the use of a widest range of stains bleaching.

Furthermore, the amidoacid and the mixture of amidoacid and amidoperacid show a good suds suppressing activity with surfactants selected from anionic, cationic, nonionic ampholytic, amphoteric and zwitterionic surfactants and mixtures thereof. Especially preferred surfactants are those selected from anionic, nonionic, cationic surfactants and mixtures thereof.

Most preferred surfactants for an enhanced reduction of suds formed from surfactants are nil-LAS surfactants.

A main component useful for providing the suds suppressing properties is an amidoacid of formula

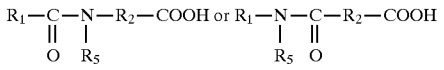

or its alkali metal, alkaline earth metal salts or mixture thereof, wherein $R_1$ is an alkyl, aryl or alkaryl group containing from 1 to 14 carbon atoms, $R_2$ is an alkylene, arylene or alkarylene group containing from 1 to 14 carbon atoms, $R_5$ is H or an alkyl, aryl, or alkaryl group containing from 1 to 10 carbon atoms.

Another suds suppressor component useful for the present invention is a mixture of amidoacid as described above and amidoperacid of formula

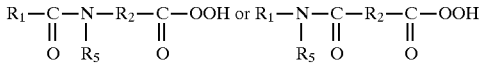

or its alkali metal, alkaline earth metal salts or mixture thereof, wherein $R_1$ is an alkyl, aryl or alkaryl group containing from 1 to 14 carbon atoms, $R_2$ is an alkylene, arylene or alkarylene group containing from 1 to 14 carbon atoms, $R_5$ is H or an alkyl, aryl, or alkaryl group containing from 1 to 10 carbon atoms.

Preferred suds suppressors such as described herein before are those wherein $R_1$ is an alkyl group containing from 6 to 12 carbon atoms, $R_2$ contains from 1 to 8 carbon atoms, and $R_5$ is H or methyl. Particularly preferred suds suppressors are those of the above general formulas wherein $R_1$ is an alkyl group containing from 7 to 10 carbon atoms and $R_2$ contains from 4 to 5 carbon atoms.

Level of said suds suppressor in the detergent composition are normally added at a level of from 0.025% to 20%, preferably from 0.05% to 15%, more preferably from 0.06% to 12% and most preferably from 0.06% to 7% by weight of the composition.

The detergent compositions in which said suds suppressors can be used include compositions which are to be used for cleaning substrates, such as fabrics, fibers, hard surfaces, skin, etc.; for example hard surface cleaning compositions (with or without abrasives), laundry detergent compositions, automatic and non-automatic dishwashing compositions.

Suds suppressor precursors

Another aspect of the present invention comprises an aqueous wash liquor containing a detersive surfactant comprising a $C_{10}$–$C_{20}$ alkyl sulphate, optionally together with builders, detergent adjuncts and a suds suppressor compound wherein said suds suppressor is formed from a suds suppressor precursor of formula

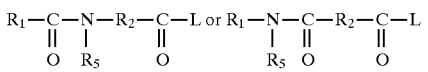

or mixtures thereof, wherein $R_1$ is an alkyl, aryl or alkaryl group containing from 1 to 14 carbon atoms, $R_2$ is an alkylene, arylene or alkarylene group containing from 1 to 14 carbon atoms, $R_5$ is H or an alkyl, aryl, or alkaryl group containing from 1 to 10 carbon atoms, and L is a leaving group.

L can be essentially any suitable leaving group. A leaving group is any group that is displaced from the suds suppressor precursor as a consequence of the nucleophilic attack on the suds suppressor precursor by the perhydroxide anion. This, the perhydrolysis reaction, results in the formation of the percarboxylic acid suds suppressor. A competing reaction can also occurs which is the hydrolysis reaction. This hydrolysis reaction results in the formation of the carboxylic acid suds suppressor. In absence of the perhydroxide anion, the nucleophilic attack is provided by the hydroxide anion which provide as for the competing reaction cited above an hydrolysis reaction. This results in the formation of the carboxylic acid suds suppressor.

Generally, for a group to be a suitable leaving group it must exert an electron attracting effect. It should also form a stable entity so that the rate of the back reaction is negligible. This facilitates the nucleophilic attack by the perhydroxide anion or the hydroxide anion.

The L group must be sufficiently reactive for the reaction to occur within the optimum time frame (e.g., a wash cycle). However, if L is too reactive, this precursor will be difficult to stabilise in detergent composition. These characteristics are generally paralleled by the pKa of the conjugate acid of the leaving group, although exceptions to this convention are known. Ordinarily, leaving groups that exhibit such behaviour are those in which their conjugate acid has a pKa in the range of from 4 to 13, preferably from 6 to 11 and most preferably from 8 to 11.

Preferred suds suppressor precursors are those of the above general formula wherein $R_1$, $R_2$ and $R_5$ are as defined for the suds suppressor (amidoacid and amidoperacid) and L is selected from

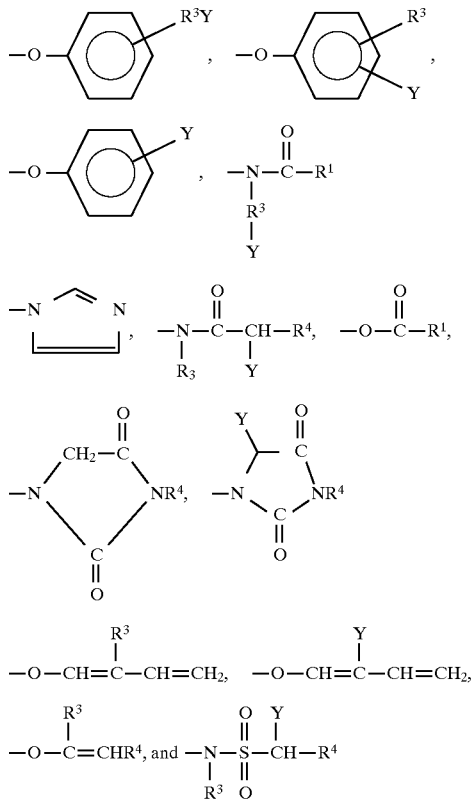

and mixtures thereof, wherein $R_1$ is an alkyl, aryl or alkaryl group containing from 1 to 14 carbon atoms, $R_3$ is an alkyl chain containing from 1 to 8 carbon atoms, $R_4$ is H or $R_3$, and Y is H or a solubilising group.

The preferred solubilising groups are $—SO_3$–M+, $—CO_2$–M+, $—SO_4$–M+, $—N^+(R_3)_4X^-$ and $O<—N(R_3)_3$ and most preferably $—SO_3^-M^+$and $—CO_2^-M^+$wherein $R_3$ is an alkyl chain containing from 1 to 4 carbon atoms, M is a cation which provides solubility to the suds suppressor precursor and X is an anion which provides solubility to the suds suppressor precursor.

Preferably, M is an alkali metal, ammonium or substituted ammonium cation, with sodium and potassium being most preferred, and X is a halide, hydroxide, methylsulphate or acetate anion. It should be noted that suds suppressor precursors with a leaving group that does not contain a solubilising group should be well dispersed in the detergent composition in order to assist in their dissolution.

Preferred suds suppressor precursors are those of the above general formula wherein L is selected from

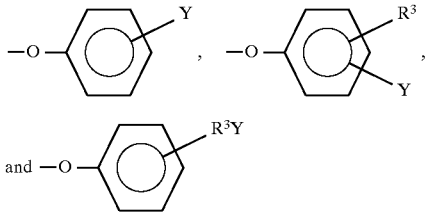

wherein R3 is as defined above and Y is $—SO_3^-M^+$or $—CO_2^-M^+$wherein M is as defined above. Preferably, L has the general formula:

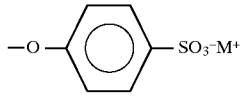

The suds suppressor precursors defined herein before will comprise at least 0.1%, preferably from 0.1% to 50%, more preferably from 0.2% to 30%, most preferably from 0.5% to 25%, by weight of the detergent composition.

Another embodiment of the present invention is the addition to the detergent composition of the invention of other suds suppressor agents and/ or detersive surfactants.

When the detergent composition of the present invention is used with additional suds suppressors such as 'silicone' and anionic surfactants, both described herein after; the ratio of said anionic surfactant to said silicone is preferably from at least 10 to 1, more preferably from at least 15 to 1.

Furthermore, if the anionic surfactant is alkyl sulphate, the preferred ratio of said alkyl sulphate to said silicone is from at least 20 to 1.

Additional suds suppressors

A wide variety of materials, well known to those skilled in the art, may be used as additional or co-suds suppressors. See, for example, Kirk Othmer Encyclopaedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons such as paraffin, fatty acid esters (e.g., fatty acid triglycerides), fatty acid esters of monovalent alcohols, aliphatic $C_{18}$–$C_{40}$ ketones (e.g., stearone), etc. Other suds inhibitors include N-alkylated amino triazines such as tri- to hexa-alkylmelamines or di- to tetraalkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., K, Na, and Li) phosphates and phosphate esters. The hydrocarbons such as paraffin and haloparaffin can be utilized in liquid form. The liquid hydrocarbons will be liquid at room temperature and atmospheric pressure, and will have a pour point in the range of −40° C. and 50° C., and a minimum boiling point not less than 110° C. (atmospheric pressure). It is also known to utilise waxy hydrocarbons, preferably having a melting point below 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo et al. The hydrocarbons, thus, include aliphatic, alicyclic, aromatic, and heterocyclic saturated or unsaturated hydrocarbons having from 12 to 70 carbon atoms. The term "paraffin," as used in this suds suppressor discussion, is intended to include mixtures of true paraffins and cyclic hydrocarbons.

Another preferred category of non-surfactant suds suppressors comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed or fused onto the silica. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al, and in U.S. Pat. No. 4,652,392, Baginski et al, issued Mar. 24, 1987.

An exemplary silicone based suds suppressor for use herein is a suds suppressing amount of a suds controlling agent consisting essentially of:

(i) polydimethylsiloxane fluid having a viscosity of from 20 cs. to 1,500 cs. at 25° C.;

(ii) from 5 to 50 parts per 100 parts by weight of (i) of siloxane resin composed of $(CH_3)_3SiO_{1/2}$ units of $SiO_2$ units in a ratio of from (CH3)3 $SiO_{1/2}$ units and to SiO2 units of from 0.6:1 to 1.2:1; and (iii) from 1 to 20 parts per 100 parts by weight of (i) of a solid silica gel.

In the preferred silicone suds suppressor used herein, the solvent for a continuous phase is made up of certain polyethylene glycols or polyethylene-polypropylene glycol copolymers or mixtures thereof (preferred), or polypropylene glycol. The primary silicone suds suppressor is branched/crosslinked and preferably not linear.

To illustrate this point further, typical liquid laundry detergent compositions with controlled suds will optionally comprise from 0.001 to 1, preferably from 0.01 to 0.7, most preferably from 0.05 to 0.5, weight % of said silicone suds suppressor, which comprises (1) a nonaqueous emulsion of a primary antifoam agent which is a mixture of (a) a polyorganosiloxane, (b) a resinous siloxane or a silicone resin-producing silicone compound, (c) a finely divided filler material, and (d) a catalyst to promote the reaction of mixture components (a), (b) and (c), to form silanolates; (2) at least one nonionic silicone surfactant; and (3) polyethylene glycol or a copolymer of polyethylene-polypropylene glycol having a solubility in water at room temperature of more than 2 weight %; and without polypropylene glycol. Similar amounts can be used in granular compositions, gels, etc. See also U.S. Pat. Nos. 4,978,471, Starch, issued Dec. 18, 1990, and 4,983,316, Starch, issued Jan. 8, 1991, 5,288,431, Huber et al., issued Feb. 22, 1994, and U.S. Pat. Nos. 4,639,489 and 4,749,740, Aizawa et al at column 1, line 46 through column 4, line 35.

The silicone suds suppressor herein preferably comprises polyethylene glycol and a copolymer of polyethylene glycol/polypropylene glycol, all having an average molecular weight of less than 1,000, preferably between 100 and 800. The polyethylene glycol and polyethylene/polypropylene copolymers herein have a solubility in water at room temperature of more than 2 weight %, preferably more than 5 weight %.

The preferred solvent herein is polyethylene glycol having an average molecular weight of less than 1,000, more preferably between 100 and 800, most preferably between 200 and 400, and a copolymer of polyethylene glycol/polypropylene glycol, preferably PPG 200/PEG 300. Preferred is a weight ratio of between 1:1 and 1:10, most preferably between 1:3 and 1:6, of polyethylene glycol:copolymer of polyethylene-polypropylene glycol.

The preferred silicone suds suppressors used herein do not contain polypropylene glycol, particularly of 4,000 molecular weight. They also preferably do not contain block copolymers of ethylene oxide and propylene oxide, like PLURONIC L101.

Other suds suppressors useful herein comprise the secondary alcohols (e.g., 2-alkyl alkanols) and mixtures of such alcohols with silicone oils, such as the silicones disclosed in U.S. Pat. Nos. 4,798,679, 4,075,118 and EP 150,872. The secondary alcohols include the $C_6$–$C_{16}$ alkyl alcohols having a $C_1$–$C_{16}$ chain. A preferred alcohol is 2-butyl octanol, which is available from Condea under the trademark ISOFOL 12. Mixtures of secondary alcohols are available under the trademark ISALCHEM 123 from Enichem. Mixed suds suppressors typically comprise mixtures of alcohol+silicone at a weight ratio of 1:5 to 5:1.

Another highly preferred foam regulator system is described in WO 93/17772, which system is a granular free flowing foam regulator containing carrier free from surfactant. The surfactant component is preferably a $C_{12}$–$C_{22}$ alkyl sulphate, an alkyl polyglycoside especially based on glucose with a $C_{12}$–$C_{18}$ alkyl group and/or an alkali salt of a sulphonation product of a (m)ethyl ester of a $C_{12}$–$C_{22}$ fatty acid. The system is free from SiO2, the carrier is free from phosphate and is water-soluble or -dispersible, and the paraffin wax is solid at room temperature and up to 100% by weight liquid at below 90° C.

By antifoam compound it is meant herein any compound or mixtures of compounds which act such as to depress the foaming or sudsing produced by a solution of a detergent composition, particularly in the presence of agitation of that solution.

An exemplary foam regulator system for use herein is granular, free-flowing foam regulator which contains:

1-a granular, surfactant-free carrier, and 2-an adsorbed uniform defoamer mixture free from siloxane polymers and emulsifying or dispersant tensides, containing a)-70–95% by weight of a paraffin wax or mixture and b)-30–5% of a bisamide from $C_2$–$C_7$ diamines and $C_{12}$–$C_{22}$ saturated carboxylic acids.

Another highly preferred antifoam controller is described in WO 94/00547, which antifoam controller is lecithin, preferably soya-lecithin.

The compositions herein will generally comprise from 0% to 5% of additional suds suppressors. When utilized as suds suppressors, monocarboxylic fatty acids, and salts therein, will be present typically in amounts up to 5%, by weight, of the detergent composition. Preferably, from 0.5% to 3% of fatty monocarboxylate suds suppressor is utilized. Silicone suds suppressors are typically utilized in amounts up to 2.0%, by weight, of the detergent composition, although higher amounts may be used. This upper limit is practical in nature, due primarily to concern with keeping costs minimised and effectiveness of lower amounts for effectively controlling sudsing. Preferably from 0.01% to 1% of silicone suds suppressor is used, more preferably from 0.25% to 0.5%. As used herein, these weight percentage values include any silica that may be utilized in combination with polyorganosiloxane, as well as any adjunct materials that may be utilized. Monostearyl phosphate suds suppressors are generally utilized in amounts ranging from 0.1% to 2%, by weight, of the composition. Hydrocarbon suds suppressors are typically utilized in amounts ranging from 0.01% to 5.0%, although higher levels can be used. The alcohol suds suppressors are typically used at 0.2%–3% by weight of the finished compositions.

Detersive surfactants

Nonlimiting examples of surfactants useful herein typically at levels from 1% to 55%, by weight, include the conventional $C_{11}$–$C_{18}$ alkyl benzene sulphonates ("LAS") and primary, branched-chain and random $C_{10}$–$C_{20}$ alkyl sulphates ("AS"), the $C_{10}$–$C_{18}$ secondary (2,3) alkyl sulphates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least 7, preferably at least 9, and M is a water-solubilizing cation, especially sodium, unsaturated sulphates such as oleyl sulphate, the $C_{10}$–$C_{18}$ alkyl alkoxy sulphates ("$AE_x$"; especially EO 1–7 ethoxy sulphates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulphated polyglycosides, and $C_{12}$–$C_{18}$ alpha-sulfonated fatty acid esters.

Preferably, the detergent composition is substantially free of LAS surfactant (i.e. less than 1%, preferably less than 0.5% of LAS surfactant by weight of the composition and most preferably contains no LAS surfactant).

If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions.

Amine oxide is a useful detersive surfactant for the purpose of the invention as it gives a strong cleaning benefit in combination with other detersive surfactants such as Oleyl sarcosinate. Especially preferred, when used in combination with other surfactants, is the C14 amine oxide.

The $C_{10}$–$C_{18}$ N-alkyl polyhydroxy fatty acid amides can also be used. Typical examples include the $C_{12}$–$C_{18}$ N-methylglucamides. See WO 92/06154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. Mixtures of anionic and nonionic surfactants are especially useful.

Cationic surfactants can also be used in the detergent compositions herein. Preferred cationic surfactants suitable for the purpose of the invention are Coco N-hydroxyethyl-N,N-dimethyl ammonium salts and choline ester. Other conventional useful surfactants are listed in standard texts.

Additional detergent components

The detergent compositions of the invention may also contain additional detergent components. The precise nature of these additional components, and levels of incorporation thereof will depend on the physical form of the composition, and the nature of the cleaning operation for which it is to be used.

The compositions of the invention may for example, be formulated as hand and machine laundry detergent compositions, including laundry additive compositions and compositions suitable for use in the pretreatment of stained fabrics and machine dishwashing compositions.

When formulated as compositions suitable for use in a machine washing method, eg: machine laundry and machine dishwashing methods, the compositions of the invention preferably contain one or more additional detergent components selected from bleach activators and preformed peracids, bleaching agents and mixtures thereof. When preformed peracids are used, they may be selected from amidoperacid, diperacid and mixtures thereof.

Bleach activators

If present, the amount of bleach activators will typically be from 0.1% to 60%, more typically from 0.5% to 40% of the detergent composition. These activators contains one or more N- or O-acyl groups and can be selected from a wide range of classes.

Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. Also included as bleach activators are the benzoyl oxybenzene sulfonate as disclosed in, for example, EP-A-0341947 and cationic derivatives of the benzoyl oxybenzene sulphonates. See also U.S. 4,634,551 for other typical bleaches and activators useful herein.

A useful class of bleach activators is the amido suds suppressor precursors of the invention, which may also function as an activator. These activators can additionally be used with other activators such as described herein (NOBS, TAED, benzoxazin activators, acyl lactam activators and cationic activators and mixtures thereof)

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

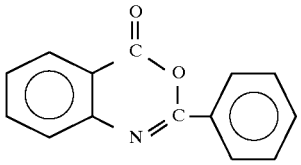

Still another class of preferred bleach activators includes the acyl lactam activators, especially acyl caprolactams and acyl valerolactams of the formulae:

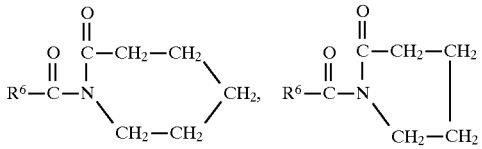

wherein $R^6$ is H or an alkyl, aryl, alkoxyaryl, or alkaryl group containing from 1 to 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Another class of preferred bleach activators include the cationic bleach activators, derived from the valerolactam and acyl caprolactam compounds, of formula:

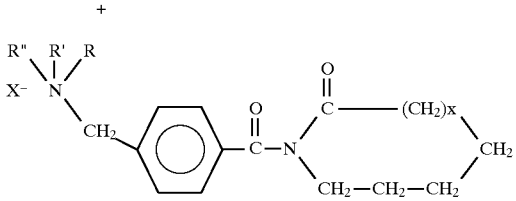

wherein x is 0 or 1, substituents R, R' and R" are each $C_1$–$C_{10}$ alkyl or $C_2$–$C_4$ hydroxy alkyl groups, or $[(C_yH_{2y})O]_n$-R'" wherein y=2–4, n=1–20 and R'" is a $C_1$–$C_4$ alkyl group or hydrogen and X is an anion.

Bleaching agents

The detergent compositions herein may optionally contain bleaching agents. When present, bleaching agents will typically be at levels of from 1% to 30%, more typically from 5% to 20%, of the detergent composition, especially for fabric laundering.

The bleaching agents used herein can be any of the bleaching agents useful for detergent compositions in textile cleaning, hard surface cleaning, or other cleaning purposes that are now known or become known. These include oxygen bleaches as well as other bleaching agents. Alkali metal perborate bleaches, e.g., sodium perborate (e.g., mono- or tetra-hydrate) can be used herein.

Peroxygen bleaching agents can also be used. Suitable peroxygen bleaching compounds include sodium carbonate peroxyhydrate and equivalent of "percarbonate" bleaches, sodium pyrophosphate peroxyhydrate, urea peroxyhydrate, and sodium peroxide. Persulphate bleach (e.g., OXONE, manufactured commercially by DuPont) can also be used.

A preferred percarbonate bleach comprises dry particles having an average particle size in the range from 500 micrometers to 1,000 micrometers, not more than 10% by weight of said particles being smaller than 200 micrometers and not more than 10% by weight of said particles being larger than 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid and nonyl amido peroxy adipic acid as described in U.S. Pat. No. 4,634,551, issued Jan. 6, 1987 to Burns et al.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from 0.025% to 1.25%, by weight, of such bleaches, especially sulfonate zinc phthalocyanine.

If desired, the bleaching compounds can be catalysed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u-O)_3$(1,4,7-trimethyl-1,4,7-triazacyclononane)$_2$(PF6)$_2$, $Mn^{III}_2(u-O)_1(u-OAc)_2$(1,4,7-trimethyl-1,4,7-triazacyclononane)$_2$-$(ClO_4)_2$, $Mn^{IV}_4(u-O)_6$(1,4,7-triazacyclononane)$_4(ClO_4)_4$, $Mn^{III}Mn^{IV}_4$-(u-O) (u-OAc)$_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos. 4,728,455; 5,284,944; 5,246,612; 5,256,779; 5,280,117; 5,274,147; 5,153,161; 5,227,084.

As a practical matter, and not by way of limitation, the compositions and processes herein can be adjusted to provide on the order of at least one part per ten million of the active bleach catalyst species in the aqueous washing liquor, and will preferably provide from 0.1 ppm to 700 ppm, more preferably from 1 ppm to 500 ppm, of the catalyst species in the laundry liquor.

ADJUNCT INGREDIENTS

The compositions herein can optionally include one or more other detergent adjunct materials or other materials for assisting or enhancing cleaning performance, treatment of the substrate to be cleaned, or to modify the aesthetics of the detergent composition (e.g., perfumes, colorants, dyes, etc.). The following are illustrative examples of such adjunct materials.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition and its desired physical form. When present, the compositions will typically comprise at least 1% builder. Liquid formulations typically comprise from 5% to 50%, more typically 5% to 30%, by weight, of detergent builder. Granular formulations typically comprise from 10% to 80%, more typically from 15% to 50% by weight, of the detergent builder. Lower or higher levels of builder, however, are not meant to be excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$: $Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2Si_2O_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2Si_2O_5$ (NaSKS-6 form) is most preferred for use herein. Other silicates may also be useful such as for example magnesium silicate, which can serve as a crispening agent in granular formulations, as a stabilising agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$Na_z[(AlO_2)_z(SiO_2)_y].xH_2O$$

wherein z and y are integers of at least 6, the molar ratio of z to y is in the range from 1.0 to 0.5, and x is an integer from 15 to 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$Na_{12}[(AlO_2)_{12}(SiO_2)_{12}]xH_2O$ wherein x is from 20 to 30, especially 27. This material is known as Zeolite A. Dehydrated zeolites (x=0–10) may also be used herein. Preferably, the aluminosilicate has a particle size of 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralised salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Chelating Agents

The detergent compositions herein may also optionally contain one or more iron and/or manganese chelating agents. Such chelating agents can be selected from the group amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from 0.1% to 10% by weight of the detergent compositions herein. More preferably, if utilized, the chelating agents will comprise from 0.1% to 3.0% by weight of such compositions.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to 5 mg by weight, more typically 0.01 mg to 3 mg, of active enzyme per gram of the composition. Stated otherwise, the compositions herein will typically comprise from 0.001% to 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries. FUNGAMYL (Novo) is especially useful.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as Pseudomonas stutzeri ATCC 19.154, as disclosed in British Pat. No. 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulphate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilised by various techniques. Enzyme stabilisation techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilisation systems are also described, for example, in U.S. Pat. No. 3,519,570.

Clay Soil Removal/Anti-redeposition Agents

The compositions of the present invention can also optionally contain water-soluble ethoxylated amines having clay soil removal and antiredeposition properties. Granular detergent compositions which contain these compounds typically contain from 0.01% to 10.0% by weight of the water-soluble ethoxylates amines; liquid detergent compositions typically contain 0.01% to 5%.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-antiredeposition agents are the cationic compounds disclosed in European Patent Application 111,965, Oh and Gosselink, published Jun. 27, 1984. Other clay soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other clay soil removal and/or anti redeposition agents known in the art can also be utilized in the compositions herein. Another type of preferred antiredeposition agent includes the carboxy methyl cellulose (CMC) materials. These materials are well known in the art.

Polymeric Dispersing Agents

Polymeric dispersing agents can advantageously be utilized at levels from 0.1% to 7%, by weight, in the compositions herein, especially in the presence of zeolite and/or layered silicate builders. Suitable polymeric dispersing agents include polymeric polycarboxylates and polyethylene glycols, although others known in the art can also be used. It is believed, though it is not intended to be limited by theory, that polymeric dispersing agents enhance overall detergent builder performance, when used in combination with other builders (including lower molecular weight polycarboxylates) by crystal growth inhibition, particulate soil release peptization, and anti-redeposition.

Polymeric polycarboxylate materials can be prepared by polymerising or copolymerizing suitable unsaturated monomers, preferably in their acid form. Unsaturated monomeric acids that can be polymerised to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein or monomeric segments, containing no carboxylate radicals such as vinylmethyl ether, styrene, ethylene, etc. is suitable provided that such segments do not constitute more than 40% by weight.

Particularly suitable polymeric polycarboxylates can be derived from acrylic acid. Such acrylic acid-based polymers which are useful herein are the water-soluble salts of polymerised acrylic acid. The average molecular weight of such polymers in the acid form preferably ranges from 2,000 to 10,000, more preferably from 4,000 to 7,000 and most preferably from 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred component of the dispersing/anti-redeposition agent. Such materials include the water-soluble salts of copolymers of acrylic acid and maleic acid. The average molecular weight of such copolymers in the acid form preferably ranges from 2,000 to 100,000, more preferably from 5,000 to 75,000, most preferably from 7,000 to 65,000. The ratio of acrylate to maleate segments in such copolymers will generally range from 30:1 to 1:1, more preferably from 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982, as well as in EP 193,360, published Sep. 3, 1986, which also describes such polymers comprising hydroxypropylacrylate. Still other useful dispersing agents include the maleic/acrylic/vinyl alcohol terpolymers. Such materials are also disclosed in EP 193,360, including, for example, the 45/45/10 terpolymer of acrylic/maleic/vinyl alcohol.

Another polymeric material which can be included is polyethylene glycol (PEG). PEG can exhibit dispersing agent performance as well as act as a clay soil removal-antiredeposition agent. Typical molecular weight ranges for these purposes range from 500 to 100,000, preferably from 1,000 to 50,000, more preferably from 1,500 to 10,000.

Polyaspartate and polyglutamate dispersing agents may also be used, especially in conjunction with zeolite builders. Dispersing agents such as polyaspartate preferably have a molecular weight (avg.) of 10,000.

Polymeric Soil Release Agent

Any polymeric soil release agent known to those skilled in the art can optionally be employed in the compositions and processes of this invention. Polymeric soil release agents are characterised by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerisation of at least 2, or (ii) oxypropylene or polyoxypropylene segments with a degree of polymerisation of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least 25% oxyethylene units and more preferably, especially for such components having 20 to 30 oxypropylene units, at least 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerisation of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Typically, the polyoxyethylene segments of (a)(i) will have a degree of polymerisation of from 200, although higher levels can be used, preferably from 3 to 150, more preferably from 6 to 100. Suitable oxy $C_4$–$C_6$ alkylene hydrophobe segments include, but are not limited to, end-caps of polymeric soil release agents such as $MO_3S(CH_2)_nOCH_2CH_2O$—, where M is sodium and n is an integer from 4–6, as disclosed in U.S. Pat. No. 4,721,580, issued Jan. 26, 1988 to Gosselink.

Polymeric soil release agents useful in the present invention also include cellulosic derivatives such as hydroxyether cellulosic polymers, copolymeric blocks of ethylene terephthalate or propylene terephthalate with polyethylene oxide or polypropylene oxide terephthalate, and the like. Such agents are commercially available and include hydroxyethers of cellulose such as METHOCEL (Dow). Cellulosic soil release agents for use herein also include those selected from the group $C_1$–$C_4$ alkyl and $C_4$ hydroxyalkyl cellulose; see U.S. Pat. No. 4,000,093, issued Dec. 28, 1976 to Nicol, et al.

Soil release agents characterised by poly(vinyl ester) hydrophobe segments include graft copolymers of poly (vinyl ester), e.g., $C_1$–$C_6$ vinyl esters, preferably poly(vinyl acetate) grafted onto polyalkylene oxide backbones, such as polyethylene oxide backbones. See European Patent Application 0 219 048, published Apr. 22, 1987 by Kud, et al. Commercially available soil release agents of this kind include the SOKALAN type of material, e.g., SOKALAN HP-22, available from BASF (West Germany).

One type of preferred soil release agent is a copolymer having random blocks of ethylene terephthalate and polyethylene oxide (PEO) terephthalate. The molecular weight of this polymeric soil release agent is in the range of from 25,000 to 55,000. See U.S. Pat. No. 3,959,230 to Hays, issued May 25, 1976 and U.S. Pat. No. 3,893,929 to Basadur issued Jul. 8, 1975.

Another preferred polymeric soil release agent is a polyester with repeat units of ethylene terephthalate units contains 10–15% by weight of ethylene terephthalate units together with 90–80% by weight of polyoxyethylene terephthalate units, derived from a polyoxyethylene glycol of average molecular weight 300–5,000. Examples of this polymer include the commercially available material ZELCON 5126 (from Dupont) and MILEASE T (from ICI). See also U.S. Pat. No. 4,702,857, issued Oct. 27, 1987 to Gosselink.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone. These soil release agents are described fully in U.S. Pat. No. 4,968,451, issued Nov. 6, 1990 to J. J. Scheibel and E. P. Gosselink. Other suitable polymeric soil release agents include the terephthalate polyesters of U.S. Pat. No. 4,711,730, issued Dec. 8, 1987 to Gosselink et al, the anionic end-capped oligomeric esters of U.S. Pat. No. 4,721,580, issued Jan. 26, 1988 to Gosselink, and the block polyester oligomeric compounds of U.S. Pat. No. 4,702,857, issued Oct. 27, 1987 to Gosselink.

Preferred polymeric soil release agents also include the soil release agents of U.S. Pat. No. 4,877,896, issued Oct. 31, 1989 to Maldonado et al, which discloses anionic, especially sulfoarolyl, end-capped terephthalate esters.

If utilized, soil release agents will generally comprise from 0.01% to 10.0%, by weight, of the detergent compositions herein, typically from 0.1% to 5%, preferably from 0.2% to 3.0%.

Still another preferred soil release agent is an oligomer with repeat units of terephthaloyl units, sulfoisoterephthaloyl units, oxyethyleneoxy and oxy-1,2-propylene units. The repeat units form the backbone of the oligomer and are preferably terminated with modified isethionate end-caps. A particularly preferred soil release agent of this type comprises one sulfoisophthaloyl unit, 5 terephthaloyl units, oxyethyleneoxy and oxy-1,2-propyleneoxy units in a ratio of from 1.7 to 1.8, and two end-cap units of sodium 2-(2-hydroxyethoxy)-ethanesulphonate. Said soil release agent also comprises from 0.5% to 20%, by weight of the oligomer, of a crystalline-reducing stabiliser, preferably selected from the group xylene sulfonate, cumene sulfonate, toluene sulfonate, and mixtures thereof.

Dye Transfer Inhibiting Agents

The compositions of the present invention may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from 0.01% to 10% by weight of the composition, preferably from 0.01% to 5%, and more preferably from 0.05% to 2%.

More specifically, the polyamine N-oxide polymers preferred for use herein contain units having the following structural formula: R—$A_x$—P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

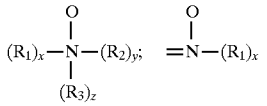

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1: 1,000,000. However, the number of amine oxide groups present in the polyamine oxide polymer can be varied by appropriate copolymerization or by an appropriate degree of N-oxidation. The polyamine oxides can be obtained in almost any degree of polymerisation. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the detergent compositions herein is poly(4-vinylpyridine-N-oxide) which as an average molecular weight of 50,000 and an amine to amine N-oxide ratio of 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present invention compositions also may employ a polyvinylpyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696, incorporated herein by reference. Compositions containing PVP can also contain polyethylene glycol ("PEG") having an average molecular weight from 500 to 100,000, preferably from 1,000 to 10,000. Preferably, the ratio of PEG to PVP on a ppm basis delivered in wash solutions is from 2:1 to 50: 1, and more preferably from 3:1 to 10:1.

The detergent compositions herein may also optionally contain from 0.005% to 5% by weight of certain types of hydrophilic optical brighteners which also provide a dye transfer inhibition action. If used, the compositions herein will preferably comprise from 0.01% to 1% by weight of such optical brighteners.

The hydrophilic optical brighteners useful in the present invention are those having the structural formula:

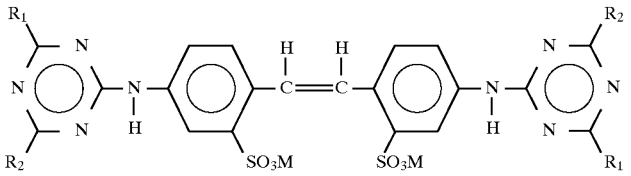

wherein $R_1$ is selected from anilino, N-2-bis-hydroxyethyl and NH-2-hydroxyethyl; $R_2$ is selected from N-2-bis-hydroxyethyl, N-2- hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis [(4-anilino-6-(N-2-bis-hydroxyethyl)-s-triazine-2-yl)amino]-2,2 '-stilbenedisulfonic acid and disodium salt. This particular brightener species is commercially marketed under the tradename Tinopal-UNPA-GX by Ciba-Geigy Corporation. Tinopal-UNPA-GX is the preferred hydrophilic optical brightener useful in the detergent compositions herein.

When in the above formula, $R_1$ is anilino, $R_2$ is N-2-hydroxyethyl- N-2-methylamino and M is a cation such as sodium, the brightener is 4,4'-bis [(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl morphilino-s-triazine-2-yl)amino]2,2'-stilbenedisulfonic acid, sodium salt. This particular brightener species is commercially marketed under the tradename Tinopal AMS-GX by Ciba Geigy Corporation.

The specific optical brightener species selected for use in the present invention provide especially effective dye transfer inhibition performance benefits when used in combination with the selected polymeric dye transfer inhibiting agents hereinbefore described. The combination of such selected polymeric materials (e.g., PVNO and/or PVPVI) with such selected optical brighteners (e.g., Tinopal UNPA-GX, Tinopal 5BM-GX and/or Tinopal AMS-GX) provides significantly better dye transfer inhibition in aqueous wash solutions than does either of these two detergent composition components when used alone. Without being bound by theory, it is believed that such brighteners work this way because they have high affinity for fabrics in the wash solution and therefore deposit relatively quick on these fabrics. The extent to which brighteners deposit on fabrics in the wash solution can be defined by a parameter called the "exhaustion coefficient". The exhaustion coefficient is in general as the ratio of a) the brightener material deposited on fabric to b) the initial brightener concentration in the wash liquor. Brighteners with relatively high exhaustion coefficients are the most suitable for inhibiting dye transfer in the context of the present invention.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Brightener

Any optical brighteners or other brightening or whitening agents known in the art can be incorporated at levels typically from 0.05% to 1.2%, by weight, into the detergent compositions herein. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles, and other miscellaneous agents. Examples of such brighteners are disclosed in "The Production and Application of Fluorescent Brightening Agents", M. Zahradnik, Published by John Wiley & Sons, New York (1982).

Specific examples of optical brighteners which are useful in the present compositions are those identified in U.S. Pat. No. 4,790,856, issued to Wixon on Dec. 13, 1988. These brighteners include the PHORWHITE series of brighteners from Verona. Other brighteners disclosed in this reference include: Tinopal UNPA, Tinopal CBS and Tinopal 5BM; available from Ciba-Geigy; Artic White CC and Artic White CWD, available from Hilton-Davis, located in Italy; the 2-(4-styryl-phenyl)-2H-naptho [1,2-d]triazoles; 4,4'-bis(1,2,3-triazol-2-yl)-stilbenes; 4,4'-bis(styryl)bisphenyls; and the aminocoumarins. Specific examples of these brighteners include 4-methyl-7-diethyl- amino coumarin; 1,2-bis(-benzimidazol-2-yl)ethylene; 1,3-diphenyl-pyrazolines; 2,5-bis(benzoxazol-2-yl)thiophene; 2-styryl-naptho[1,2-d] oxazole; and 2-(stilben-4-yl)-2H-naphtho[1,2-d]triazole. See also U.S. Pat. No. 3,646,015, issued Feb. 29, 1972 to Hamilton. Anionic brighteners are preferred herein.

Fabric Softeners

Various through-the-wash fabric softeners, especially the impalpable smectite clays of U.S. Pat. No. 4,062,647, Storm and Nirschl, issued Dec. 13, 1977, as well as other softener clays known in the art, can optionally be used typically at levels of from 0.5% to 10% by weight in the present compositions to provide fabric softener benefits concurrently with fabric cleaning. Clay softeners can be used in combination with amine and cationic softeners as disclosed, for example, in U.S. Pat. No. 4,375,416, Crisp et al, Mar. 1, 1983 and U.S. Pat. No. 4,291,071, Harris et al, issued Sep. 22, 1981.

Other Ingredients

A wide variety of other ingredients useful in detergent compositions can be included in the compositions herein, including other active ingredients, carriers, hydrotropes, processing aids, dyes or pigments, solvents for liquid formulations, solid fillers for bar compositions, etc.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10, DeGussa) is admixed with a proteolytic enzyme solution containing 3%–5% of $C_{13-15}$ ethoxylated alcohol (EO 7) nonionic surfactant. Typically, the enzyme/surfactant solution is 2.5 X the weight of silica. The resulting powder is dispersed with stirring in silicone oil (various silicone oil viscosities in the range of 500–12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Liquid detergent compositions can contain water and other solvents as carriers. Low molecular weight primary or secondary alcohols exemplified by methanol, ethanol, propanol, and isopropanol are suitable. Monohydric alcohols are preferred for solubilizing surfactants, but polyols such as those containing from 2 to 6 carbon atoms and from 2 to 6 hydroxy groups (e.g., 1,3-propanediol, ethylene glycol, glycerine, and 1,2-propanediol) can also be used. The compositions may contain from 5% to 90%, typically 10% to 50% of such carriers.

The detergent compositions herein will preferably be formulated such that, during use in aqueous cleaning operations, the wash water will have a pH of between 6.5 and 11, preferably between 7.5 and 10.5.

Liquid dishwashing product formulations preferably have a pH between 6.8 and 9.0. Laundry products are typically at pH 9–11. Techniques for controlling pH at recommended usage levels include the use of buffers, alkalis, acids, etc., and are well known to those skilled in the art.

The detergent composition of the present invention is effective in soft and hard water and can be used in a well built formulation, wherein the builder content is at least 125% by weight of the formulation, as well as in a low built formulation, wherein the builder content is less than 15% by weight of the formulation.

The invention is illustrated in the following non limiting examples, in which all percentages are on a weight basis unless otherwise stated.

In the detergent compositions, the abbreviated component identifications have the following meanings:

LAS : Sodium linear $C_{12}$ alkyl benzene sulphonate

XYAS : Sodium $C_{1X}$–$C_{1Y}$ alkyl sulphate

APG : Alkyl polyglycoside surfactant of formula $C_{12}$-(glycosyl)x, where x is 1.5, 24EY : A $C_{12-14}$ predominantly linear primary alcohol condensed with an average of Y moles of ethylene oxide 45EY : A $C_{14}$–$C_{15}$ predominantly linear primary alcohol condensed with an average of Y moles of ethylene oxide XYEZS : $C_{1X}$–$C_{1Y}$ sodium alkyl sulphate condensed with an average of Z moles of ethylene oxide per mole NaSKS-6: Crystalline layered silicate of formula δ-$Na_2Si_2O_5$ Carbonate : Anhydrous sodium carbonate MA/AA : Copolymer of 1:4 maleic/acrylic acid, average molecular weight about 80,000

Zeolite A : Hydrated Sodium Aluminosilicate of formula $Na_{12}(AlO_2SiO_2)_{12}.27H_2O$ having a primary particle size in the range from 1 to 10 micrometers Citrate : Tri-sodium citrate dihydrate Citric : Citric Acid Percarbonate : Anhydrous sodium percarbonate bleach of empirical formula $2Na_2CO_3.3H_2O_2$ coated with a mixed salt of formula $Na_2SO_4.n.Na_2CO_3$ where n is 0.29 and where the weight ratio of percarbonate to mixed salt is 39:1

TAED : Tetraacetyl ethylene diamine

Protease : Proteolytic enzyme sold under the tradename Savinase by Novo Industries A/S (approx 2% enzyme activity).

Lipase : Lipolytic enzyme sold under the tradename Lipolase by Novo Industries A/S (approx 2% enzyme activity)

Cellulase : Cellulosic enzyme sold under the tradename Carezyme by Novo Industries A/S.

Endo A: Tradename of a cellulosic enzyme sold by Novo Industries A/S

PVNO : Polyvinyl pyridine N-oxide polymer of molecular weight 10,000

MgSO4: Anhydrous Magnesium Sulphate

SRP : modified anionic polyester Soil Release Polymer

CMC : Sodium carboxymethyl cellulose

EDDS: Ethylenediamine-N,N'-disuccinic acid, [S,S] isomer in the form of the sodium salt.

silicone 25% paraffin wax Mpt 50° C., 17% hydrophobic silica, 58% paraffin oil.

Suds Testing Method 110 g of the detergent formulations described herein after are taken and added to a Miele 698 washing machine containing 1.5 kg of clean, new terry towel ballast. The products are tested at 90° C., main wash cycle, using soft water (3° Clark).

The % suds is measured and calculated using the following expression:

$$\% \text{ suds} = \frac{\text{height of suds visible through port hole}}{\text{height of port hole}} * 100\%$$

4 replicates of each product are completed.

EXAMPLE 1 i)-detergent compositions

The following compositions were prepared and tested for sudsing. Composition A formed wash liquor in accordance with the prior art while composition 1 formed wash liquor in accordance with the invention and composition 2 embodiment of the invention show the suds suppression effect of differing types of amidoacid and amidoperacid.

The suds suppressor in composition 1 was a 50:50 blend of 6-octanamido caproyl oxy benzene sulphonate and 6-decanamido caproyl oxy benzene sulphonate, while the suds suppressor in composition 2 was a 50:50 blend of 6-octanamido caproic acid and 6-decanamido caproic acid.

| | A | 1 | 2 |
|---|---|---|---|
| TAED | 5 | — | — |
| 6-Octanamido/ 6 Decanamido Caproyl Oxy Benzene Sulphonate (50:50 blend) | — | 5 | — |
| 6-Octanamido/ 6 Decanamido Caproic Acid (50:50 blend) | — | — | 5 |
| C45AS | 10 | 10 | 10 |
| C25AE3S | 2 | 2 | 2 |
| C24E5 | 3 | 3 | 3 |
| N-Methyl Glucamide | 3 | 3 | 3 |
| Zeolite A | 17 | 17 | 17 |
| SKS-6 | 12 | 12 | 12 |
| Citric | 3 | 3 | 3 |
| MA/AA | 5 | 5 | 5 |
| CMC | 0.4 | 0.4 | 0.4 |
| PEG | 0.5 | 0.5 | 0.5 |
| Savinase | 2.4 | 2.4 | 2.4 |
| Lipolase | 0.2 | 0.2 | 0.2 |
| Cellulase | 0.2 | 0.2 | 0.2 |
| Endo A | 0.2 | 0.2 | 0.2 |
| SRP | 0.4 | 0.4 | 0.4 |
| PVNO | 0.02 | 0.02 | 0.02 |
| Carbonate | 6 | 6 | 6 |
| Zinc Phthalocyanine sulphonate | 20 ppm | 20 ppm | 20 ppm |
| Silicone | 0.4 | 0.4 | 0.4 |
| Percarbonate | 20 | 20 | 20 |
| Water minors and miscellaneous to balance | | | |

ii)-suds results

The above compositions are evaluated for sudsing with the suds method described herein before in medium hard water (12° Clark).

| | A | 1 | 2 |
|---|---|---|---|
| % suds (30 mns) | 85 | 28 | 6 |

The amidoacid alone gives a a very effective suds suppressing action at the foaming from the surfactant system.

EXAMPLE 2 i)-detergent compositions

The following compositions were prepared and tested for sudsing. Compositions A, B, C formed wash liquors in accordance with the prior art while composition 1, 2, 3, 4 formed wash liquors in accordance with the invention show the suds suppression effect of differing levels of amidoacid and amidoperacid.

The suds suppressor in compositions 1–4 was a 50:50 blend of 6-octanamido caproyl oxy benzene sulphonate and 6-decanamido caproyl oxy benzene sulphonate.

| | A | B | C | 1 | 2 | 3 | 4 |
|---|---|---|---|---|---|---|---|
| LAS | 10 | — | — | 10 | — | — | — |
| C45AS | — | 10 | 10 | — | 10 | 10 | 10 |
| Silicone | 0.3 | 0.3 | 0.3 | 0.3 | — | 0.3 | 0.3 |
| TAED | 5 | 5 | — | — | — | — | 3 |
| 6-Octanamido 6 Decanamido Caproyl Oxy Benzene Sulphonate (50:50 blend) | — | — | — | 5 | 5 | 5 | 3 |
| C45E7 | 4 | 4 | 4 | 4 | 4 | 4 | 4 |
| Zeolite A | 18 | 18 | 18 | 18 | 18 | 18 | 18 |

-continued

| | A | B | C | 1 | 2 | 3 | 4 |
|---|---|---|---|---|---|---|---|
| SKS-6 | 8 | 8 | 8 | 8 | 8 | 8 | 8 |
| Citric | 4 | 4 | 4 | 4 | 4 | 4 | 4 |
| MA/AA | 4 | 4 | 4 | 4 | 4 | 4 | 4 |
| SRP | 0.3 | 0.3 | 0.3 | 0.3 | 0.3 | 0.3 | 0.3 |
| CMC | 0.3 | 0.3 | 0.3 | 0.3 | 0.3 | 0.3 | 0.3 |
| EDDS | 0.4 | 0.4 | 0.4 | 0.4 | 0.4 | 0.4 | 0.4 |
| MgSO4 | 0.4 | 0.4 | 0.4 | 0.4 | 0.4 | 0.4 | 0.4 |
| Percarbonate | 18 | 18 | 18 | 18 | 18 | 18 | 18 |
| Carbonate | 4.5 | 4.5 | 4.5 | 4.5 | 4.5 | 4.5 | 4.5 |
| Savinase | 1.2 | 1.2 | 1.2 | 1.2 | 1.2 | 1.2 | 1.2 |
| Lipolase | 0.4 | 0.4 | 0.4 | 0.4 | 0.4 | 0.4 | 0.4 |
| Cellulase | 0.1 | 0.1 | 0.1 | 0.1 | 0.1 | 0.1 | 0.1 |
| Water minors and miscellaneous to balance | | | | | | | |

ii)-suds results

| | A | B | C | 1 | 2 | 3 | 4 |
|---|---|---|---|---|---|---|---|
| % suds at 30 minutes | 70 | 100 | 100 | 65 | 60 | 12 | 25 |

From the suds test above, it is seen that LAS is a lower foaming surfactant than coco AS.

After 30 mns of stressed suds testing, the blend is perhydrolized in its peracid form, said peracid giving the acid. The mixture, of amidoacid and amidoperacid suds suppressor, obtained reduces the foaming of LAS and AS. A better reduction is seen with the foaming of the AS surfactant.

EXAMPLE 3 i)-detergent compositions

The following compositions were prepared and tested for sudsing and cleaning. Compositions A and B formed wash liquors in accordance with the prior art while compositions 1, 2, 3 formed wash liquors in accordance with the invention show the suds suppression effect of differing levels of amidoacid and amidoperacid.

The suds suppressor in compositions 1–3 was a 50:50 blend of 6-octanamido caproyl oxy benzene sulphonate and 6-decanamido caproyl oxy benzene sulphonate.

| | A | B | 1 | 2 | 3 |
|---|---|---|---|---|---|
| TAED | — | 6 | — | 4 | — |
| 6-Octanamido/ 6 Decanamido Caproyl Oxy Benzene Sulphonate (50:50 blend) | — | — | 5 | 3 | 3 |
| Benzoyl Caprolactam | — | — | — | — | 4 |
| C45AS | 10 | 10 | 10 | 10 | 10 |
| C25AE3S | 2 | 2 | 2 | 2 | 2 |
| C24E5 | 3 | 3 | 3 | 3 | 3 |
| N-Methyl Glucamide | 3 | 3 | 3 | 3 | 3 |
| Zeolite A | 17 | 17 | 17 | 17 | 17 |
| SKS-6 | 12 | 12 | 12 | 12 | 12 |
| Citric | 3 | 3 | 3 | 3 | 3 |
| MA/AA | 5 | 5 | 5 | 5 | 5 |
| CMC | 0.4 | 0.4 | 0.4 | 0.4 | 0.4 |
| PEG | 0.5 | 0.5 | 0.5 | 0.5 | 0.5 |
| Savinase | 2.4 | 2.4 | 2.4 | 2.4 | 2.4 |
| Lipolase | 0.2 | 0.2 | 0.2 | 0.2 | 0.2 |
| Cellulase | 0.2 | 0.2 | 0.2 | 0.2 | 0.2 |
| Endo A | 0.2 | 0.2 | 0.2 | 0.2 | 0.2 |
| SRP | 0.4 | 0.4 | 0.4 | 0.4 | 0.4 |

-continued

| | A | B | 1 | 2 | 3 |
|---|---|---|---|---|---|
| PVNO | 0.02 | 0.02 | 0.02 | 0.02 | 0.02 |
| Carbonate | 6 | 6 | 6 | 6 | 6 |
| Zinc Phthalocyanine sulphonate | 20 ppm | 20 ppm | 20 ppm | 20 ppm | 20 ppm |
| Silicone | 0.4 | 0.4 | 0.4 | 0.4 | 0.4 |
| Percarbonate | 20 | 20 | 20 | 20 | 20 |
| Water minors and miscellaneous to balance | | | | | |

ii)-suds results

The above compositions are evaluated for sudsing with the suds method described herein before and for performance on a range of hydrophobic and body soils by using a launderometer at 40° C. with hard water (12° Clark)

| | A | B | 1 | 2 | 3 |
|---|---|---|---|---|---|
| % suds (30 mns) | 100 | 100 | 15 | 30 | 22 |
| Performance (psu vs A) | | | | | |
| lipstick | 0 | +0.5 | +4.0s | +3.0s | +3.5s |
| shoe polish | 0 | +0.6 | +4.0s | +3.0s | +3.6s |
| tea | 0 | +3.0 | +1.5 | +2.8 | +3.3 |
| coffee | 0 | +2.8 | +1.3 | +2.5 | +3.1 |

The mixture obtained of amidoacid and amidoperacid gives a very effective suds suppressing action at the foaming from the surfactant system and also provides effective cleaning performance on hydrophobic soils like lipstick and polish.

Furthermore, when the detergent composition of the invention is formulated with additional precursor like TAED or benzoyl caprolactam, the suds suppression properties and performance on hydrophobic stains as well as the performance on hydrophilic stains like tea and coffee are retained.

EXAMPLE 4 i)-detergent compositions

The following compositions were prepared and tested for sudsing. Compositions A and B formed wash liquors in accordance with the prior art while composition 1, 2, 3 formed wash liquors in accordance with the invention show the suds suppression effect of differing levels of amidoacid and amidoperacid.

The suds suppressor in compositions 1–3 was a 50:50 blend of 6-octanamido caproyl oxy benzene sulphonate and 6-decanamido caproyl oxy benzene sulphonate.

| | A | B | 1 | 2 | 3 |
|---|---|---|---|---|---|
| TAED | — | 6 | — | 4 | — |
| 6-Octanamido/6 Decanamido Caproyl Oxy Benzene Sulphonate (50:50 blend) | — | — | 5 | 3 | 3 |
| Benzoyl Caprolactam | — | — | — | — | 4 |
| C45AS | 5 | 5 | 5 | 5 | 5 |
| C12–C14 alkyl (N-hydroxy ethyl-N,N-dimethyl ammonium bromide) | 5 | 5 | 5 | 5 | 5 |

-continued

| | A | B | 1 | 2 | 3 |
|---|---|---|---|---|---|
| C25AE3S | 2 | 2 | 2 | 2 | 2 |
| C24E7 | 3 | 3 | 3 | 3 | 3 |
| N-Methyl Glucamide | 3 | 3 | 3 | 3 | 3 |
| Zeolite A | 17 | 17 | 17 | 17 | 17 |
| SKS-6 | 12 | 12 | 12 | 12 | 12 |
| Citric | 3 | 3 | 3 | 3 | 3 |
| MA/AA | 5 | 5 | 5 | 5 | 5 |
| CMC | 0.4 | 0.4 | 0.4 | 0.4 | 0.4 |
| PEG | 0.5 | 0.5 | 0.5 | 0.5 | 0.5 |
| Savinase | 2.4 | 2.4 | 2.4 | 2.4 | 2.4 |
| Lipolase | 0.2 | 0.2 | 0.2 | 0.2 | 0.2 |
| Carezyme | 0.2 | 0.2 | 0.2 | 0.2 | 0.2 |
| Endo A | 0.2 | 0.2 | 0.2 | 0.2 | 0.2 |
| SRP | 0.4 | 0.4 | 0.4 | 0.4 | 0.4 |
| PVNO | 0.02 | 0.02 | 0.02 | 0.02 | 0.02 |
| Carbonate | 6 | 6 | 6 | 6 | 6 |
| Zinc Phthalocyanine sulphonate | 20 ppm | 20 ppm | 20 ppm | 20 ppm | 20 ppm |
| Silicone | 0.4 | 0.4 | 0.4 | 0.4 | 0.4 |
| Percarbonate | 20 | 20 | 20 | 20 | 20 |
| Water minors and miscellaneous to balance | | | | | |

ii)-Suds results

The above compositions are evaluated for sudsing with the suds method described herein before in medium hard water (12° Clark).

| | A | B | 1 | 2 | 3 |
|---|---|---|---|---|---|
| % suds (30 mns) | 100 | 95 | 35 | 45 | 41 |

The mixture of amidoacid and amidoperacid suds suppressors obtained from the amido acid precursor is very effective at suppressing the suds of a mixed AS/cationic surfactant system.

EXAMPLE 5 i)-Detergent compositions

The following compositions were prepared and tested for sudsing. Composition A formed wash liquor in accordance with the prior art while composition 1 and 2 formed wash liquors in accordance with the invention show the suds suppression effect of differing levels/types of amidoacid and amidoperacid.

The suds suppressor in composition 1 was 6-nonanoyl caproyl oxy benzene sulphonate, while the suds suppressor in composition 2 was nonyl amido peroxy adipic acid.

| | A | 1 | 2 |
|---|---|---|---|
| TAED | 4.5 | — | — |
| 6-Nonanoyl Caproyl Oxy Benzene Sulphonate (Mwt 287) | — | 3 | — |
| Nonyl Amido Peroxy Adipic Acid (Mwt 287) | — | — | 1.9 |
| C45AS | 10 | 10 | 10 |
| C25AE3S | 2 | 2 | 2 |
| C24E5 | 3 | 3 | 3 |
| N-Methyl Glucamide | 3 | 3 | 3 |
| Zeolite A | 17 | 17 | 17 |
| SKS-6 | 12 | 12 | 12 |
| Citric | 3 | 3 | 3 |

-continued

| | A | 1 | 2 |
|---|---|---|---|
| MA/AA | 5 | 5 | 5 |
| CMC | 0.4 | 0.4 | 0.4 |
| PEG | 0.5 | 0.5 | 0.5 |
| Savinase | 2.4 | 2.4 | 2.4 |
| Lipolase | 0.2 | 0.2 | 0.2 |
| Carezyme | 0.2 | 0.2 | 0.2 |
| Endo A | 0.2 | 0.2 | 0.2 |
| SRP | 0.4 | 0.4 | 0.4 |
| PVNO | 0.02 | 0.02 | 0.02 |
| Carbonate | 6 | 6 | 6 |
| Zinc Phthalocyanine sulphonate | 20 ppm | 20 ppm | 20 ppm |
| Silicone | 0.4 | 0.4 | 0.4 |
| Percarbonate | 20 | 20 | 20 |
| Water minors and miscellaneous to balance | | | |

ii)-Suds results

The above compositions are evaluated for sudsing with the suds method described herein before in soft water (3° Clark) and in hard water (18° Clark).

| % suds (20 mns) | A | 1 | 2 |
|---|---|---|---|
| Soft water | 80 | 35 | 49 |
| Hard water | 81 | 31 | 43 |

The mixture of amidoacid and amidoacid suds suppressor obtained from the amido acid precursor is an effective suds suppression agent of high foaming surfactants in hard water, as well as in soft water. The mixture of said suds suppressor agent also gives better suds suppression results than the nonyl amido peroxy adipic acid.

EXAMPLE 6 i)-detergent compositions

The following compositions were prepared and tested for sudsing and cleaning. Composition A formed wash liquor in accordance with the prior art while compositions 1, 2, 3, 4, 5 formed wash liquors in accordance with the invention show the suds suppression effect of differing levels/types of amidoacid and amidoperacid.

The suds suppressor in compositions 1–4 was a 50:50 blend of 6-octanamido caproyl oxy benzene sulphonate and 6-decanamido caproyl oxy benzene sulphonate, while the suds suppressor in composition 5 was 6-decanamido caproyl oxy benzene sulphonate.

| | A | 1 | 2 | 3 | 4 | 5 |
|---|---|---|---|---|---|---|
| Percarbonate | 17 | — | 17 | 8 | 25 | 17 |
| Additional Carbonate | — | 12 | — | 6 | — | — |
| 6-Octanamido/6 Decanamido Caproyl Oxy Benzene Sulphonate (50:50 blend) | — | 3 | 3 | 3 | 3 | — |
| 6 Decanamido Caproyl Oxy Benzene Sulphonate | — | — | — | — | — | 3 |
| C45AS | 10 | 10 | 10 | 10 | 10 | 10 |
| C25AE3S | 2 | 2 | 2 | 2 | 2 | 2 |
| C24E5 | 3 | 3 | 3 | 3 | 3 | 3 |
| N-Methyl Glucamide | 3 | 3 | 3 | 3 | 3 | 3 |

-continued

| | A | 1 | 2 | 3 | 4 | 5 |
|---|---|---|---|---|---|---|
| Zeolite A | 17 | 17 | 17 | 17 | 17 | 17 |
| SKS-6 | 12 | 12 | 12 | 12 | 12 | 12 |
| Citric | 3 | 3 | 3 | 3 | 3 | 3 |
| MA/AA | 5 | 5 | 5 | 5 | 5 | 5 |
| CMC | 0.4 | 0.4 | 0.4 | 0.4 | 0.4 | 0.4 |
| PEG | 0.5 | 0.5 | 0.5 | 0.5 | 0.5 | 0.5 |
| Savinase | 2.4 | 2.4 | 2.4 | 2.4 | 2.4 | 2.4 |
| Lipolase | 0.2 | 0.2 | 0.2 | 0.2 | 0.2 | 0.2 |
| Carezyme | 0.2 | 0.2 | 0.2 | 0.2 | 0.2 | 0.2 |
| Endo A | 0.2 | 0.2 | 0.2 | 0.2 | 0.2 | 0.2 |
| SRP | 0.4 | 0.4 | 0.4 | 0.4 | 0.4 | 0.4 |
| PVNO | 0.02 | 0.02 | 0.02 | 0.02 | 0.02 | 0.02 |
| Carbonate | 6 | 6 | 6 | 6 | 6 | 6 |
| Zinc Phthalocyanine sulphonate | 20 ppm | 20 ppm | 20 ppm | 20 ppm | 20 ppm | 20 ppm |
| Silicone | 0.4 | 0.4 | 0.4 | 0.4 | 0.4 | 0.4 |
| Water minors and miscellaneous to balance | | | | | | |

ii)-suds and performance results

The above compositions are evaluated for sudsing with the suds method described herein before in medium hard water (12° Clark).

| | A | 1 | 2 | 3 | 4 | 5 |
|---|---|---|---|---|---|---|
| % suds (25 mns) | 100 | 30 | 44 | 60 | 6511 | 35 |
| Performance (40° C.) | | | | | | |
| Lipstick | 0 | +1.6 | +3.8 | +3.5 | +3.6 | +4.0 |
| Polish | 0 | +1.4 | +3.6 | +3.2 | +3.6 | +4.0 |

Both the amidoacid or the mixture of amidoacid and amidoperacid obtained from the amidoacid precursor act as a suds suppressor agent and give effective cleaning performance on hydrophobic soils like lipstick and polish.

From the results above, it is seen that the percarbonate:amido acid precursor ratio may be varied without detracting significantly from its performance or suds suppressing properties.

EXAMPLE 7 i)-detergent compositions

The following compositions were prepared and tested for sudsing. Compositions 1, 2, 3, 4, 5, 6, 7 formed wash liquors in accordance with the invention show the suds suppression effect of amidoacid and amidoperacid.

The suds suppressor in compositions 1–7 was a 50:50 blend of 6-octanamido caproyl oxy benzene sulphonate and 6-decanamido caproyl oxy benzene sulphonate.

| | 1 | 2 | 3 | 4 | 5 | 6 | 7 |
|---|---|---|---|---|---|---|---|
| 6-octanamido/6 Decanamido Caproyl Oxy Benzene Sulphonate (50:50 blend) | 3 | 3 | 3 | 3 | 3 | 3 | 3 |
| Benzoyl Caprolactam | 4 | 4 | 4 | 4 | 4 | 4 | 4 |
| Percarbonate | 17 | 17 | 17 | 17 | 17 | 17 | 17 |
| C45 AS | 12 | 6 | — | 9 | 12 | 14.3 | 10 |
| C38 AS | 3 | 3 | — | 2 | 3 | 3.7 | 3.7 |
| C25 AES | 3 | 1.5 | 3 | 2 | 3 | — | — |
| C24 E3 | 5 | — | — | — | — | 5 | 5 |
| Palm N-Methyl | 4 | 9 | — | 4 | 9 | 4 | 4 |

-continued

| | 1 | 2 | 3 | 4 | 5 | 6 | 7 |
|---|---|---|---|---|---|---|---|
| Glucamide | | | | | | | |
| APG | — | — | 9 | 5 | — | — | — |
| Oleyl Sarcosinate | — | 7.5 | 15 | 5 | — | — | — |
| Amine Oxide | — | — | — | — | — | — | 4 |
| Zeolite A | 5 | 5 | 5 | 5 | 5 | 5 | 5 |
| SKS-6 | 7 | 7 | 7 | 7 | 7 | 7 | 7 |
| Citric Acid/ Citrate | 3 | 3 | 3 | 3 | 3 | 3 | 3 |
| Carbonate | 9 | 9 | 9 | 9 | 9 | 9 | 9 |
| MA/AA | 5 | 5 | 5 | 5 | 5 | 5 | 5 |
| EDDS | 0.25 | 0.25 | 0.25 | 0.25 | 0.25 | 0.25 | 0.25 |
| Silicone | 0.6 | 0.6 | 0.6 | 0.6 | 0.6 | 0.6 | 0.6 |
| Water minors, enzymes and miscellaneous to balance | | | | | | | |

The mixture of amidoacid and amidoperacid obtained from the amidoacid precursor acts as a very effective suds suppressing agent with various mixed surfactant systems and also gives a good bleaching activity on hydrophobic soils.

I claim:

1. An aqueous wash liquor comprising:

(a) a detersive surfactant comprising a $C_{10}$–$C_{20}$ alkyl sulphate;

(b) an ingredient selected from the group consisting of sulfonated zinc phthalocyanines, sulfonated aluminum phthalocyanines and mixtures thereof; and (c) a suds suppressor compound of the formula:

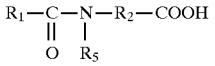

or

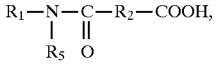

wherein said suds suppressor is formed from a suds suppressor precursor of formula:

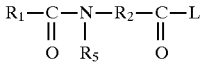

or

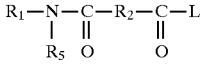

wherein $R_1$ is an allyl, aryl or alkaryl group containing from 1 to 14 carbon atoms, $R_2$ is an alkaline, arylene or alkarylene group containing from 1 to 14 carbon atoms, and $R_5$ is H or an alkyl, aryl, or alkaryl group containing from 1 to 10 carbon atoms and L is a leaving group.

2. An aqueous wash liquor according to claim 1, further containing additional suds suppressor agents selected from the group consisting of silicone, lecithin, and defoaming mixtures containing paraffin wax and bis-amide.

3. An aqueous wash liquor according to claim 1, wherein L is selected from the group consisting of

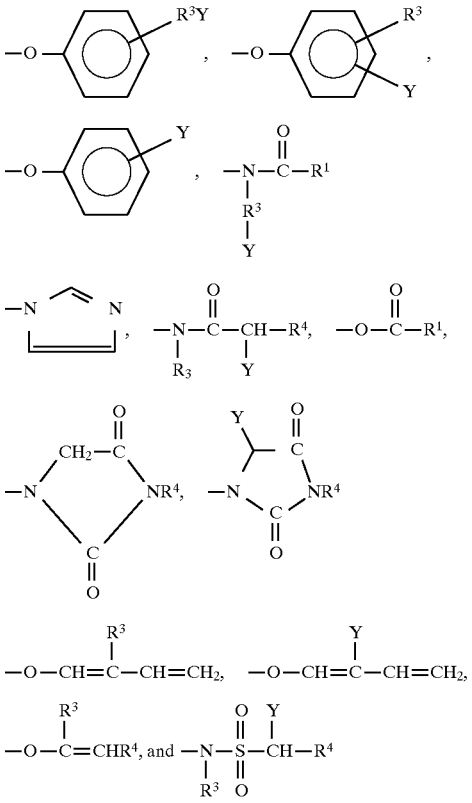

and mixtures thereof, wherein $R_1$ is as defined in claim 1, $R_3$ is an alkyl chain containing from about 1 to about 8 carbon atoms, R4 is H or R3, and Y is H or a solubilising group.

4. An aqueous wash liquor according to claim 3, wherein L has the general formula:

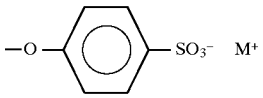

5. An aqueous wash liquor according to claim 1, wherein said suds suppressor precursor is at a level of at least 0.1%.

6. A method of suppressing sudsing, comprising the step of adding to a detergent composition a component selected from the group consisting of:

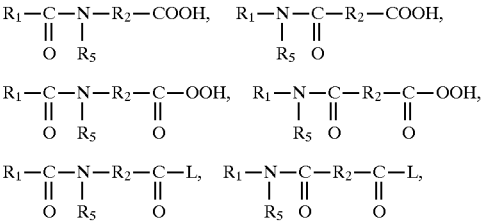

and mixtures thereof;

wherein $R_1$ is an alkyl, aryl or alkaryl group containing from 1 to 14 carbon atoms, $R_2$ is an alkaline, arylene or alkarylene group containing from 1 to 14 carbon atoms, $R_5$ is H or an alkyl, aryl, or alkaryl group containing from 1 to 10 carbon atoms and L is a leaving groups; wherein the detergent composition comprises a $C_{10}$–$C_{20}$ alkyl sulphate and an ingredient selected from the group consisting of sulfonated zinc phthalocyanines, sulfonated aluminum phthalocyanines and mixtures thereof.

7. A detergent composition according to claim 6, wherein L is selected from the group consisting of:

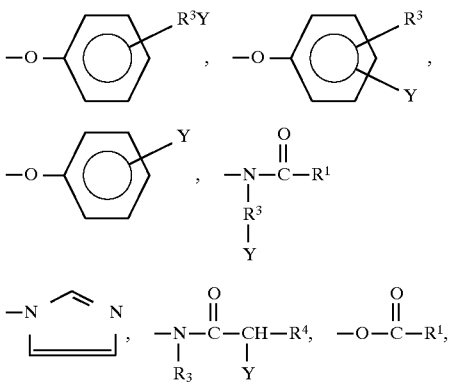

-continued

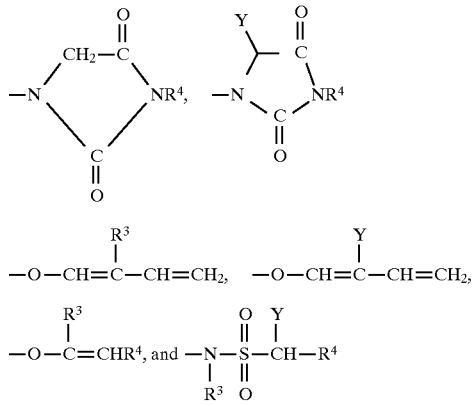

and mixtures thereof, wherein $R_1$ is an alkyl, aryl or alkaryl group containing from about 1 to about 14 carbon atoms, $R_3$ is an alkyl chain containing from about 1 to about 8 carbon atoms, $R_4$ is H or $R_3$, and Y is H or a solubilizing group.

* * * * *

UNITED STATES PATENT AND TRADEMARK OFFICE

CERTIFICATE OF CORRECTION

PATENT NO. : 5,837,670
DATED : November 17, 1998
INVENTOR(S) : Richard Timothy Hartshorn It is certified that error appears in the above-identified patent and that said Letters Patent is hereby corrected as shown below:

Column 31, line 55, "allyl" should be --alkyl--.
Column 32, line 46 add --where M is an alkali metal, ammonium or substituted ammonium cation—which was omitted from the claim.

Signed and Sealed this

Twenty-first Day of September, 1999

*Attest:*

Q. TODD DICKINSON

*Attesting Officer*

*Acting Commissioner of Patents and Trademarks*